US009108830B2

(12) United States Patent
Arner et al.

(10) Patent No.: US 9,108,830 B2
(45) Date of Patent: Aug. 18, 2015

(54) SECURE CONNECTION LOAD-REST FOR A GROUND-ENGAGING VEHICLE JACK

(71) Applicants: Jacob B. Arner, Nesquehoning, PA (US); Todd D. Ahner, Lehighton, PA (US)

(72) Inventors: Jacob B. Arner, Nesquehoning, PA (US); Todd D. Ahner, Lehighton, PA (US)

(73) Assignee: A & A Attachments, LLC, Nesquehoning, PA (US)

( * ) Notice: Subject to any disclaimer, the term of this patent is extended or adjusted under 35 U.S.C. 154(b) by 251 days.

(21) Appl. No.: 13/957,099

(22) Filed: Aug. 1, 2013

(65) Prior Publication Data

US 2015/0034890 A1 Feb. 5, 2015

(51) Int. Cl.
*B66F 3/00* (2006.01)
*B66F 3/12* (2006.01)

(52) U.S. Cl.
CPC ..... *B66F 3/12* (2013.01)

(58) Field of Classification Search
USPC ..... 254/122, 126, 133 R, 424, 425
See application file for complete search history.

(56) References Cited

U.S. PATENT DOCUMENTS

| | | | | | |
|---|---|---|---|---|---|
| 1,714,464 | A | * | 5/1929 | Merriman | 254/126 |
| 1,796,173 | A | | 3/1931 | Warren | |
| 1,994,015 | A | | 8/1933 | Curran | |
| 2,416,796 | A | | 3/1947 | Dobbs | |
| 2,577,539 | A | * | 12/1951 | Page | 60/474 |
| 2,885,181 | A | | 5/1959 | McCully et al. | |
| 3,863,894 | A | | 2/1975 | Mansi et al. | |
| 3,997,143 | A | | 12/1976 | Rose | |
| 4,811,931 | A | | 3/1989 | Bandy | |
| 4,836,502 | A | * | 6/1989 | Yamauchi | 254/126 |
| 4,865,295 | A | | 9/1989 | Halloway | |
| 5,011,119 | A | | 4/1991 | Harrington | |
| 5,013,011 | A | | 5/1991 | Halloway | |
| 5,067,692 | A | | 11/1991 | Nudd et al. | |
| 5,139,232 | A | | 8/1992 | Bailey | |
| 5,217,206 | A | | 6/1993 | Brosius et al. | |
| 5,275,378 | A | | 1/1994 | Alten | |
| 5,449,149 | A | | 9/1995 | Popowich | |
| 5,458,316 | A | | 10/1995 | Engel | |
| 5,460,352 | A | | 10/1995 | Calafi | |
| 5,516,066 | A | | 5/1996 | Fabiano et al. | |
| 5,782,457 | A | | 7/1998 | Arguelles | |
| 5,950,990 | A | | 9/1999 | Castillo | |
| 5,979,877 | A | | 11/1999 | Arguelles | |
| 6,070,856 | A | | 6/2000 | Alten | |
| 6,302,381 | B1 | | 10/2001 | Roll | |
| 6,634,688 | B2 | * | 10/2003 | Foat et al. | 296/1.01 |
| 6,779,822 | B2 | | 8/2004 | Foat et al. | |
| 2005/0127342 | A1 | * | 6/2005 | Voegeli et al. | 254/126 |
| 2011/0114906 | A1 | | 5/2011 | Papke et al. | |

* cited by examiner

*Primary Examiner* — Lee D Wilson
*Assistant Examiner* — Shantese McDonald
(74) *Attorney, Agent, or Firm* — Harold I. Masteller

(57) ABSTRACT

The present invention is directed to a load-rest that provides a secure and stable connection between a ground-engaging jack and a vehicle, the load-rest includes a frame bracket fixed to the vehicle and a clamp assembly fixed to the ground-engaging jack. The clamp assembly comprises a first clamp jaw opposite a second clamp jaw that is biased toward a closed position so that both clamp jaws clasp the frame bracket when inserted into an aperture provided therein. The clamp assembly also includes a tenon that extends in an upward direction to connect with a mortise in the frame bracket and provide a mortise and tenon joint therebetween, whereby the biased clamp jaws, in combination with the mortise and tenon joint, provides a secure and stable connection to the vehicle when a load is applied to the ground-engaging jack.

24 Claims, 5 Drawing Sheets

SECURE CONNECTION LOAD-REST FOR A GROUND-ENGAGING VEHICLE JACK

FIELD OF THE INVENTION

The present invention is directed to a load-rest for a ground-engaging jack, and in particular, it is directed to a load-rest that provides a secure and stable connection between a ground-engaging jack and a vehicle by providing a frame bracket fixed to the vehicle and a clamp assembly that includes a standing bracket with a first clamp jaw and a sliding bracket with a second clamp jaw, the sliding bracket biased toward the standing bracket so that both the first and second jaws clasp and suspend the ground-engaging jack from the frame bracket, the standing bracket further includes tenon that corresponds with a mortise in the frame bracket to provide a mortise-tenon joint therewith.

BACKGROUND OF THE INVENTION

Ground-engaging jacks are suspended from a vehicle and they are operated to lower the jack so that it contacts the ground to lift, support, or level the vehicle. Such ground-engaging jacks are used to level and/or support parked trailers, for example but not limited to, travel trailers or motorhomes broadly known as RV's. They are also used to lift and lower vehicles during maintenance procedures. When used with RV's, ground-engaging jacks are typically a permanent part of the vehicle, and they can be automatically or manually extended from a retracted stored position located beneath the vehicle to a working position for leveling or supporting the vehicle. When in the stored position, leveling jacks are typically positioned to extend beneath, parallel to the vehicle, and with the stored base member stored perpendicular to the ground. In some mounting configurations, the base will extend below the body of the vehicle. Since the clearance between the RV and the ground is limited, the base of the leveling jack often digs into high spots or obstructions at a campsite. In certain instances, the base and/or jack assembly will collide with high spots along a road surface when the RV is towed or driven from place to place. For example, the jack assembly may come into contact with speed bumps, smash into the road surface when the RV encounters abrupt road transitions, hits a pothole or road debris. Such unexpected road hazards can damage the jack assembly and may cause the jack to become inoperable. Furthermore, environmental road conditions such as rain, snow, and/or ice along with road salt, mud, dirt, or grime, will cause the stored ground-engaging jack mechanism to corrode and/or become coated with grunge making the jack difficult to operate or even making it inoperable. It should also be noted that when ground-engaging jacks are permanently fixed to a vehicle they create an aerodynamic drag on a moving vehicle. Such drag is eliminated when a ground-engaging jack is only fixed to the vehicle when in use to lift, support, or level the vehicle.

In the instance where a ground-engaging jack is used to raise or lower a vehicle during maintenance, it is extremely important to provide a secure and stable connection between the jack and vehicle to prevent accidental collapses and injury. Such collapses can be caused by placing the jack (or lift) in or at a position where the load rest does not make proper contact with the vehicle frame or it does not engage the vehicle at a correct location along the frame. Improper contact and/or engagement between a jack and vehicle is often the result of the jack base engaging ground surface irregularities such as depressions, humps, slopes, or the like, that cause the jack to extend at an unstable angle. The frame bracket of the present invention ensures that the load rest can only be attached to the vehicle at a predetermined position along the vehicle frame, and the combination standing bracket and sliding bracket provided by the present load rest enables the jack to engage the ground at a perpendicular lift angle between the jack and vehicle, and in particular, where the jack base engages an uneven or sloped ground surface.

SUMMARY OF THE INVENTION

Accordingly, it is a first object of the present invention to provide a load-rest for a ground-engaging jack that is simple to either attach or remove from a vehicle.

It is another object of the present invention to provide a load-rest for a ground-engaging jack that interlocks with a frame bracket that is permanently fixed to the underside of a vehicle to provide a secure connection between the vehicle and ground-engaging jack.

It is still another object of the present invention to provide a load-rest that includes a combination standing clamp jaw and biased clamp jaw that engage and clasp the frame bracket fixed to the underside of a vehicle.

Another object of the present invention is to provide a load-rest with a combination frame bracket and clamp assembly that includes a standing bracket and a biased sliding bracket where the standing bracket includes a tenon that interlocks with a mortise provided in the frame bracket fixed to the underside of the vehicle.

It is still a further object of the present invention to provide a load-rest for a ground-engaging jack with an interlocking frame bracket and clamp assembly connection that prevents the clamp assembly from twisting out of or free from the frame bracket connection when a load is applied to the ground-engaging jack.

In satisfaction of the foregoing objects and advantages, the present invention is directed to a load-rest that provides a secure and stable connection between a ground-engaging jack and a vehicle, the load-rest comprising a frame bracket and a clamp assembly adapted to be adjustably attached to or detached from the frame bracket, the clamp assembly including a standing bracket and a sliding bracket biased toward the standing bracket, the biased sliding bracket includes a clamp jaw positioned to engage and clasp the frame bracket when attached, the standing bracket includes a clamp jaw positioned to engage and clasp the frame bracket in combination with a tenon that corresponds with a mortise in the frame bracket to provide a mortise and tenon joint therebetween when attached.

DESCRIPTION OF THE PRESENT INVENTION

The present invention is directed to a load-rest device for use with a ground-engaging vehicle jack, and in particular, it is directed to a load-rest device that provides a secure and stable connection between a ground-engaging jack and a vehicle by providing a combination frame bracket fixed to the vehicle and a clamp assembly that can be either attached to or detached from the frame bracket, the clamp assembly including a standing jaw and a moveable spring-loaded jaw, both jaws having legs that engage and clamp or clasp within an aperture in the frame bracket when attached, the standing jaw further including a tenon that corresponds with a mortise in the frame bracket to provide a mortise and tenon joint therewith when attached.

As used herein, the term "ground-engaging jack" refers to any suitable jack device used to level, raise, lower, or support a vehicle including but not limited to a scissors jack, hydraulic jack, pneumatic jack, telescopic jack, or jack stand.

In addition, the term "ground" as used herein refers to either a paved or unpaved surface.

Also as used herein, the term "lift" refers to a particular instant in time when a ground-engaging jack receives an applied load and either levels, raises, or supports a vehicle.

The term "interactively," as used herein refers to the components of the present load-rest apparatus that are capable of acting upon or in close relation with each other.

As used herein the term "channel" or "channel member" refers to a c-shaped configuration similar to a structural channel produced in a rolling mill.

Figure 1:
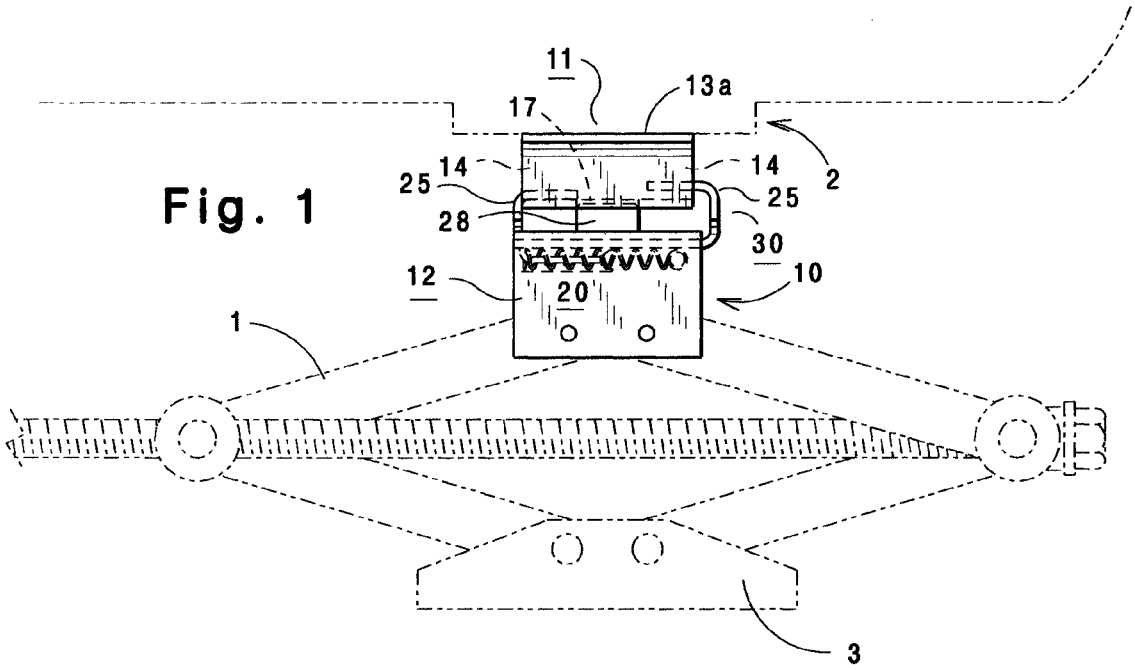
FIG. 1 is an elevation view showing the secure connection load-rest of the present invention fixed to the frame of a vehicle with an attached ground-engaging jack suspended above the ground.
Figure 2:
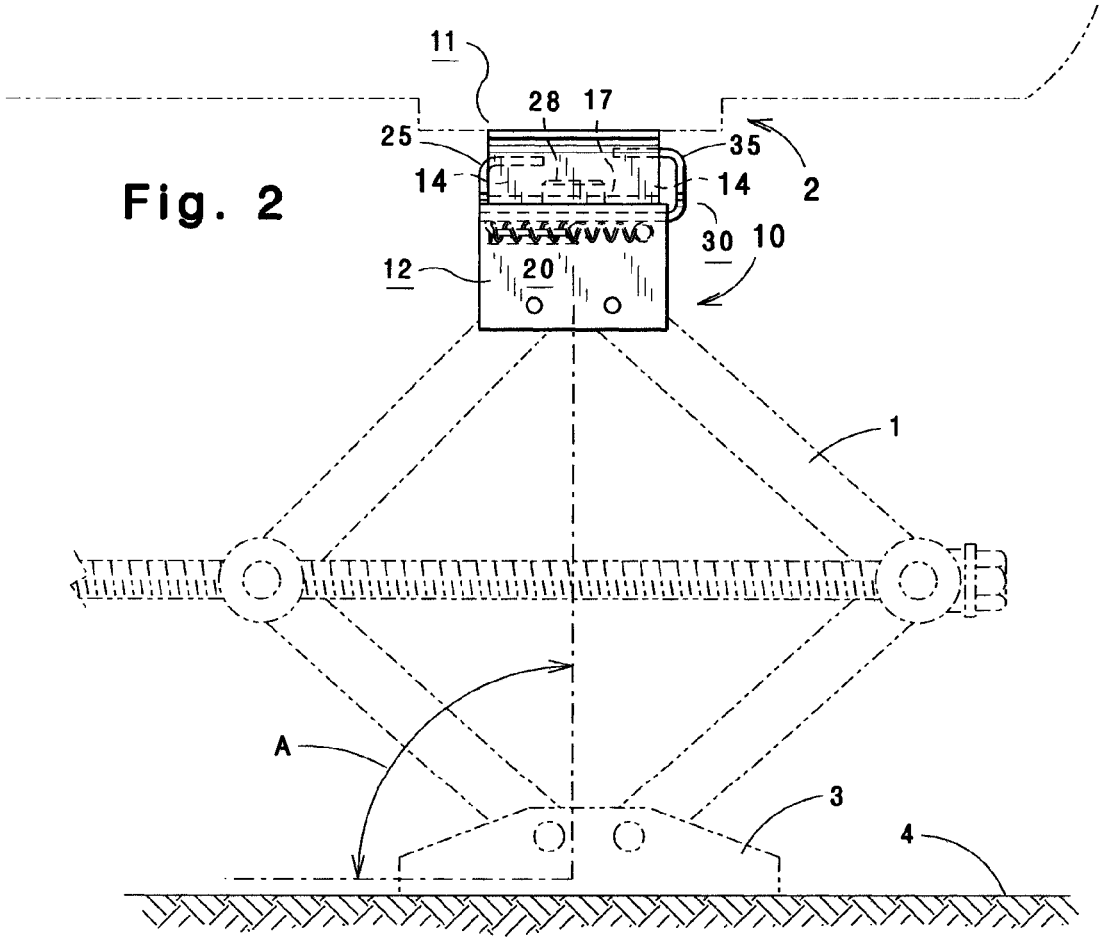
FIG. 2 is a view similar to FIG. 1 showing the ground-engaging jack extended to engage the ground and positioned to level, raise, or support a vehicle.

Furthermore, as used and claimed herein, the term "geometric design" refers to both the shape and interaction between components of the load rest assembly, namely between the frame bracket aperture and clamp jaws, and the mortise and tenon Referring now to the drawing figures, in which like numerals indicate like elements throughout the views, FIG. 1 shows the load-rest device 10 of the present invention fixed to a ground-engaging jack 1. The load-rest device 10 includes a frame bracket 11 that is fixed to a surface of the vehicle 2 such as the vehicle frame or any other suitable vehicle surface capable of supporting a jacking load, and a clamp assembly 12 that can be selectively attached to or removed from frame bracket 11 as needed. Frame bracket 11 may be fixed to the vehicle surface using any suitable fastening means that is known or becomes known in the art without departing from the scope of the present invention, for example but not limited to, welding, riveting, threaded-fasteners, or high strength epoxies. Base 3 of the ground-engaging jack 1 is suspended above the ground (not shown) and it is positioned to engage the ground surface during a lift. FIG. 2 shows the ground-engaging jack 1 extended so that base 3 contacts the ground surface 4 to support the applied load from the vehicle when jack 1 is operated to make a lift.

Figure 3:
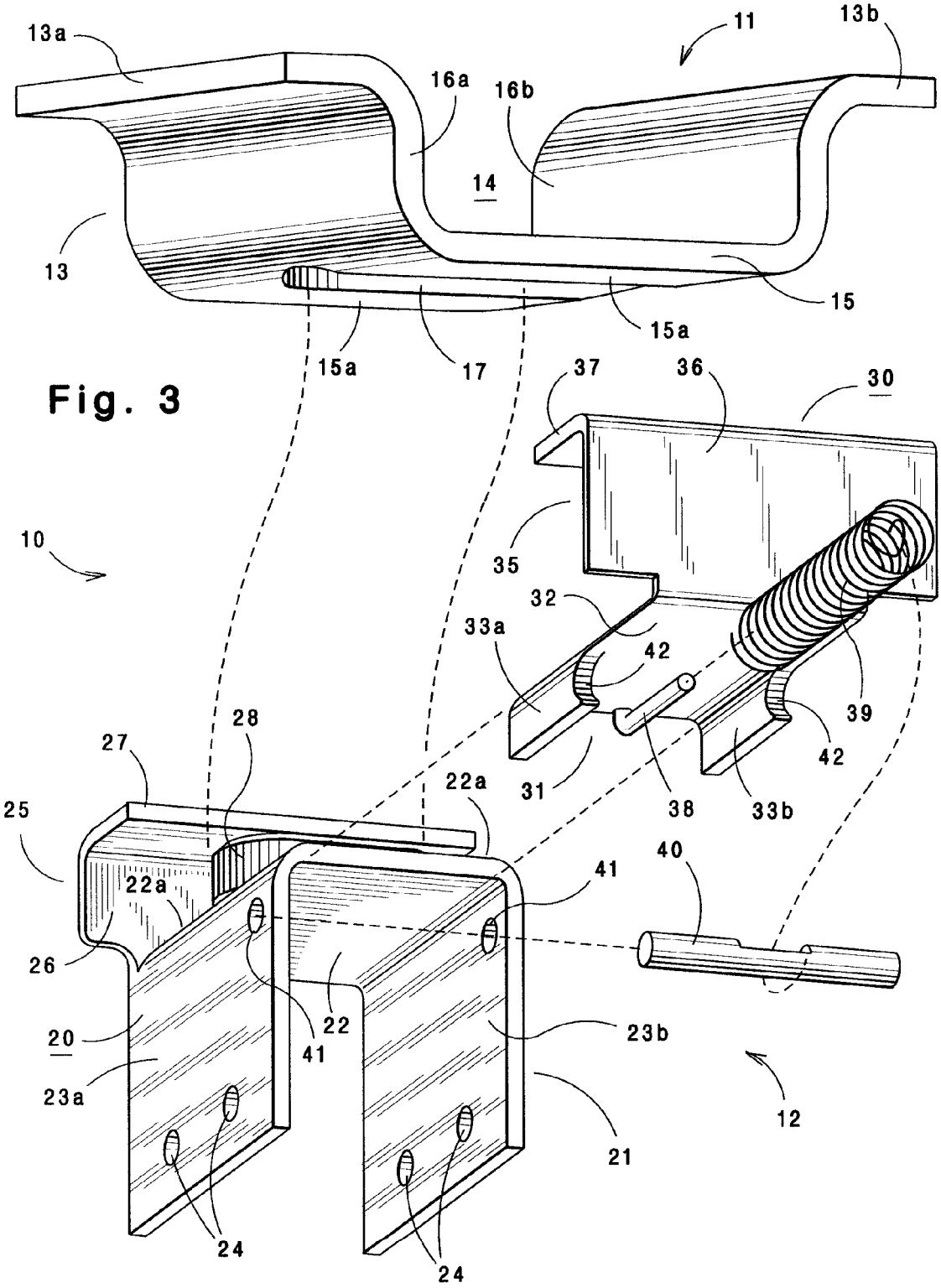
FIG. 3 is an exploded perspective view showing the secure connection load-rest frame bracket and clamp assembly.

Referring to FIG. 3, the exploded view shows the various components of the load lift device 10 including the frame bracket 11 and the clamp assembly 12. The drawing shows frame bracket 11 comprising a structural shape 13 typically called an outside lip hat section. However, the frame bracket may comprise any suitable shape or configuration without departing from the scope of the present invention as long as the suitable shape accommodates the requirements to attach the clamp assembly 12 to frame bracket 11 as herein described in the present detailed description of the invention. Referring to FIGS. 1, 2, and 3, the spaced apart outside lips 13*a* and 13*b* of frame bracket 11 are fixed to the vehicle surface by any suitable means as herein described above, and the frame bracket 11 is positioned on the vehicle to provide a transverse aperture 14 that extends toward the front and back ends of the vehicle, when attached to a longitudinal frame member. However, it should be understood that the frame bracket may also be attached to a transverse frame member, suitable bumper, suspension member or axle in which case it would provide a longitudinal aperture that would be accessed from the front or rear of the vehicle without departing from the scope of the present invention. Aperture 14 provides an open space that extends between the vehicle 2 and frame bracket 11, the aperture or open space being defined by the frame bracket web 15 and flanges 16*a* and 16*b* that extend in a downward direction from the outside lips 13*a* and 13*b*. An elongated mortise or slot 17 extends through web 15 and mortise 17 is perpendicular to aperture 14.

The clamp assembly 12 includes a standing bracket 20 and a sliding bracket 30. The standing bracket 20 comprises a channel shaped member 21 with a web 22, a first flange 23*a*, and a second 23*b*, both flanges including apertures 24 for attaching the channel member 21 to a jack. Standing bracket 20 includes a clamp jaw 25 with an upward extending leg 26 fixed proximate one end of web 22 and a second leg 27 that extends toward the opposite or second end of the web. Leg 27 is spaced apart from and above web 22. Standing bracket 20 also includes a tenon 28 that extends in an upward direction from the top surface 22*a* of the web and the tenon is shaped to correspond with and fit within mortise 17 in the frame bracket 11. The top surface 22*a* of web 22 provides shoulders that seat with the bottom surface 15*a* of frame bracket web 15 when the clamp assembly 12 is fully attached to frame bracket 11 with the tenon 28 and mortise 17 interlocked to form a mortise and tenon joint.

The sliding bracket 30 in the clamp assembly 12 comprises a channel shaped member 31 comprising a web 32, a first flange 33*a*, and a second 33*b*. The distance between the spaced apart flanges 33*a* and 33*b* is less than the distance between flanges 23*a* and 23*b* in the standing bracket channel 21 so that channel 31 can be nested within channel 21 between the flanges 23*a* and 23*b*. A second or biased clamp jaw 35 includes an upward extending leg 36 fixed proximate to one end of web 32 and includes a second leg 37 that extends toward the opposite or second end of the web. Leg 37 and is spaced apart from and above web 32 and extends outward from leg 36 toward clamp jaw 25 attached to standing bracket 20.

An arbor 38 is attached to the underside or bottom surface of web 32 and is encircled by and supports a spring 39. One end of spring 39 is fixed to a retainer pin 40 that extends through apertures 41 that extend through flanges 23*a* and 23*b* in the standing bracket channel 20. When the sliding bracket 30 is nested within standing bracket 20, between flanges 23*a* and 23*b*, the sliding bracket 30 is biased toward a closed or clamping position by spring 39 that is compressed between arbor 38 and the retainer pin 40 inserted through the apertures 41. The nested sliding bracket is able to float or move in its nested position within standing bracket 20, and bracket 30 is held in the nested position by the clamping force applied by the compressed spring 39 fixed to retainer pin 40. The second leg 27 of biased clamp jaw 35 that overlaps web 22, in combination with stop sockets 42 that are positioned in flanges 33*a* and 33*b* to engage retainer pin 41, prevent the nested sliding bracket 30 from being withdrawn from the standing bracket 20, i.e. its nested position. In other words, leg 22, arbor 38, spring 39, and stop sockets 42 maintain sliding bracket 30 in its nested position between flanges 23*a* and 23*b*.

Figure 4:
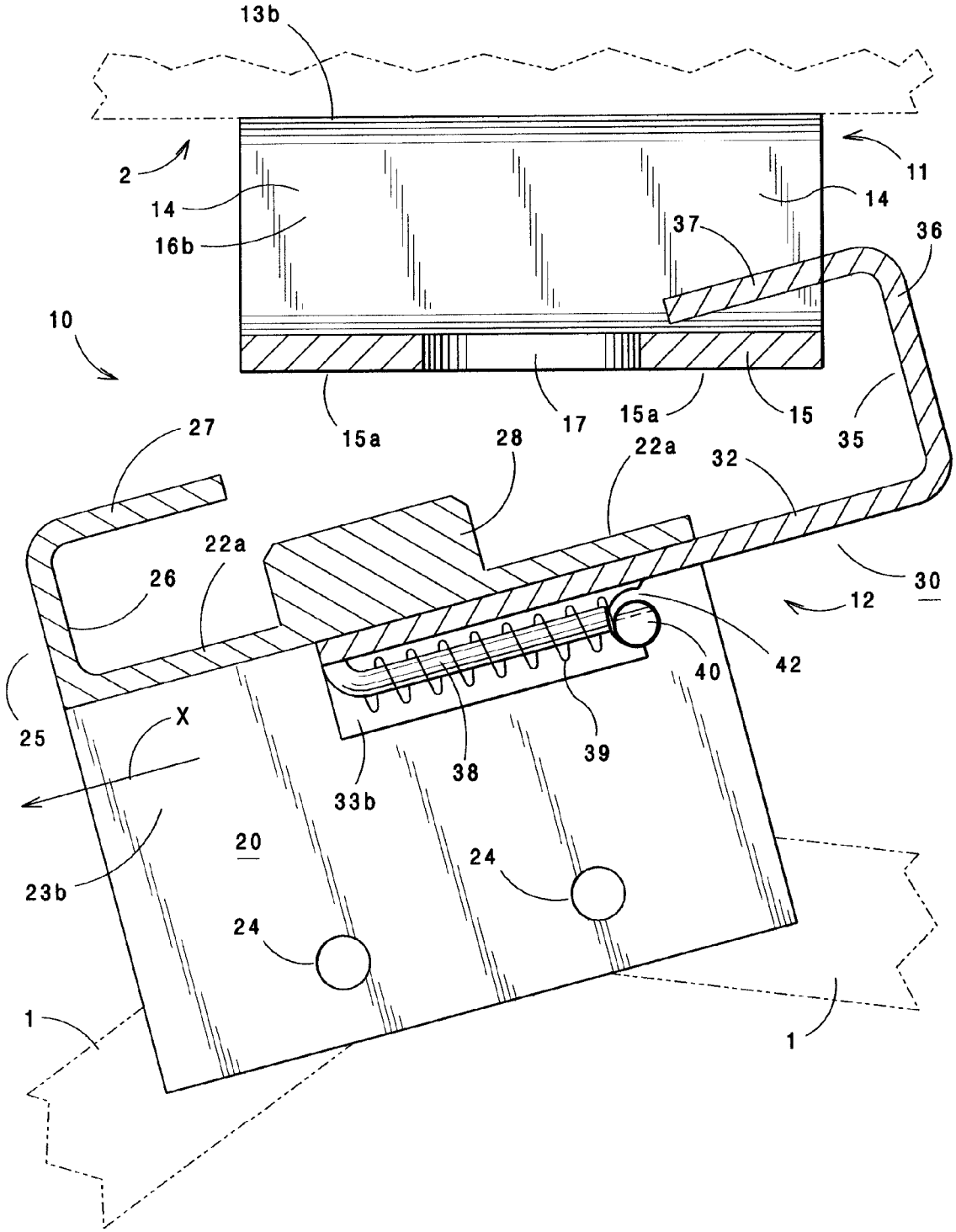
FIG. 4 is a cross-section view showing the clamp assembly positioned to interlock and clasp the frame bracket.

FIG. 4 shows the clamp assembly 12 of load-rest device 10 positioned for attachment to the frame bracket 11. In this instance the second leg 37 of clamp jaw 35 is inserted into the transverse aperture or open space 14 of frame bracket 11. A pushing force, shown as "X", is applied against the standing bracket 20 in a direction opposite to the clamping or bias force applied by compressed spring 39. The pushing force "X" causes the clamping jaws 25 and 35 to separate so that both jaws can be inserted into aperture 14 to attach the clamp assembly 12 to frame bracket 11 with the ground-engaging jack 1 suspended above the ground. As shown in FIG. 1, after both jaws are inserted into the transverse aperture or open space 14 to suspend clamp assembly 12 from frame bracket 11. Tenon 28 is aligned to be inserted within mortise 17 which enables the sliding bracket to continue to somewhat float or move within the standing bracket as described above for the sliding bracket nested position. The pushing force "X" is discontinued after the jaws are inserted into the frame bracket aperture and the sliding bracket 30 is again biased toward its closed or clamping position by compression spring 39. It should be understood however, that the second leg 27 of clamp jaw 25 may just as well be inserted into transverse aperture 14 of the frame bracket 11 and a pulling force can be applied against the sliding bracket 30 in a direction that is opposite to the clamping force applied by spring 39 to separate the clamping jaws for inserting both jaws 25 and 35 into aperture 14 without departing from the scope of the present invention.

As shown in FIG. 2, the preferred lift angle for supporting a vehicle with a jack is a perpendicular line between the ground and vehicle, or at least as near or close to a 90 degree angle "A" as practical based on the ground slope and/or condition as well as the position of the vehicle. Referring to FIG. 1, before a lift is made, clamp assembly 12 is suspended from frame bracket 11 with at least one of its clamp jaws 25 or 35 supported on frame bracket web 15, and with its tenon 28 aligned to be inserted into mortise 17. This allows the lift angle to be adjusted before base 3 supports the applied load from the vehicle.

Figure 5:
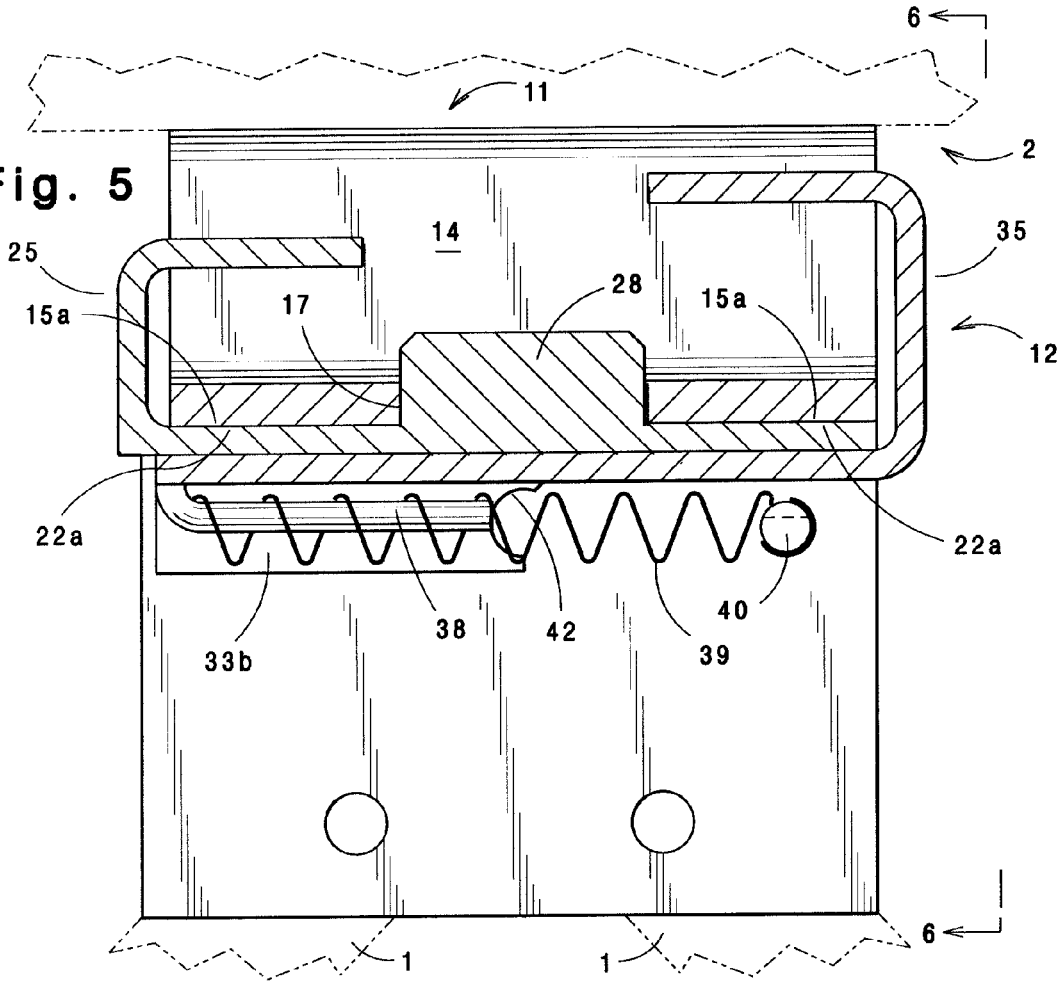
FIG. 5 is a cross-section view similar to FIG. 4 showing the clamp assembly attached to the frame bracket with both jaws clasping the frame bracket and the clamp assembly tenon engaging the frame bracket mortise.
Figure 6:
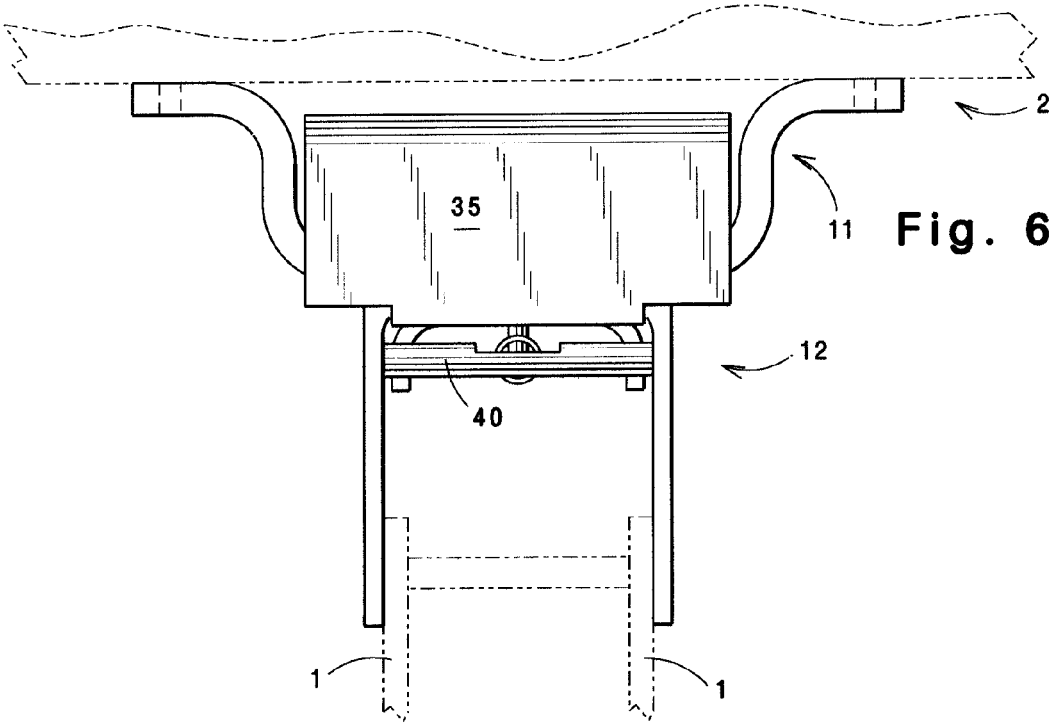
FIG. 6 is an end elevation view taken along the lines 6-6 of FIG. 5.

Referring to FIGS. 1, 5, and 6 of the drawings, when a lift is made, the applied load causes tenon 28 to become fully inserted into mortise 17 with the shoulders 22*a* provided by web 22 seated against the bottom surface 15*a* of frame bracket 11. The clamping force applied by clamp jaws 25 and 35, in combination with a collective geometric design or shape of certain load rest components, namely the frame bracket aperture, the inserted clamp jaws, and the coupled mortise and tenon joint, provides a secure and stable connection between the vehicle and ground engaging jack that prevents rotation or twist about the lift axis A when a load is applied to the jack. The collective geometric design enables the stated components to interactively function as a unit to prevent rotation or twist about the lift axis, and as a result, the inserted clamp jaws cannot geometrically rotate or twist out from the frame bracket aperture when a load is applied, making it unlikely for the vehicle to accidently slip or fall under the applied load incurred during a lift.

Figure 7:
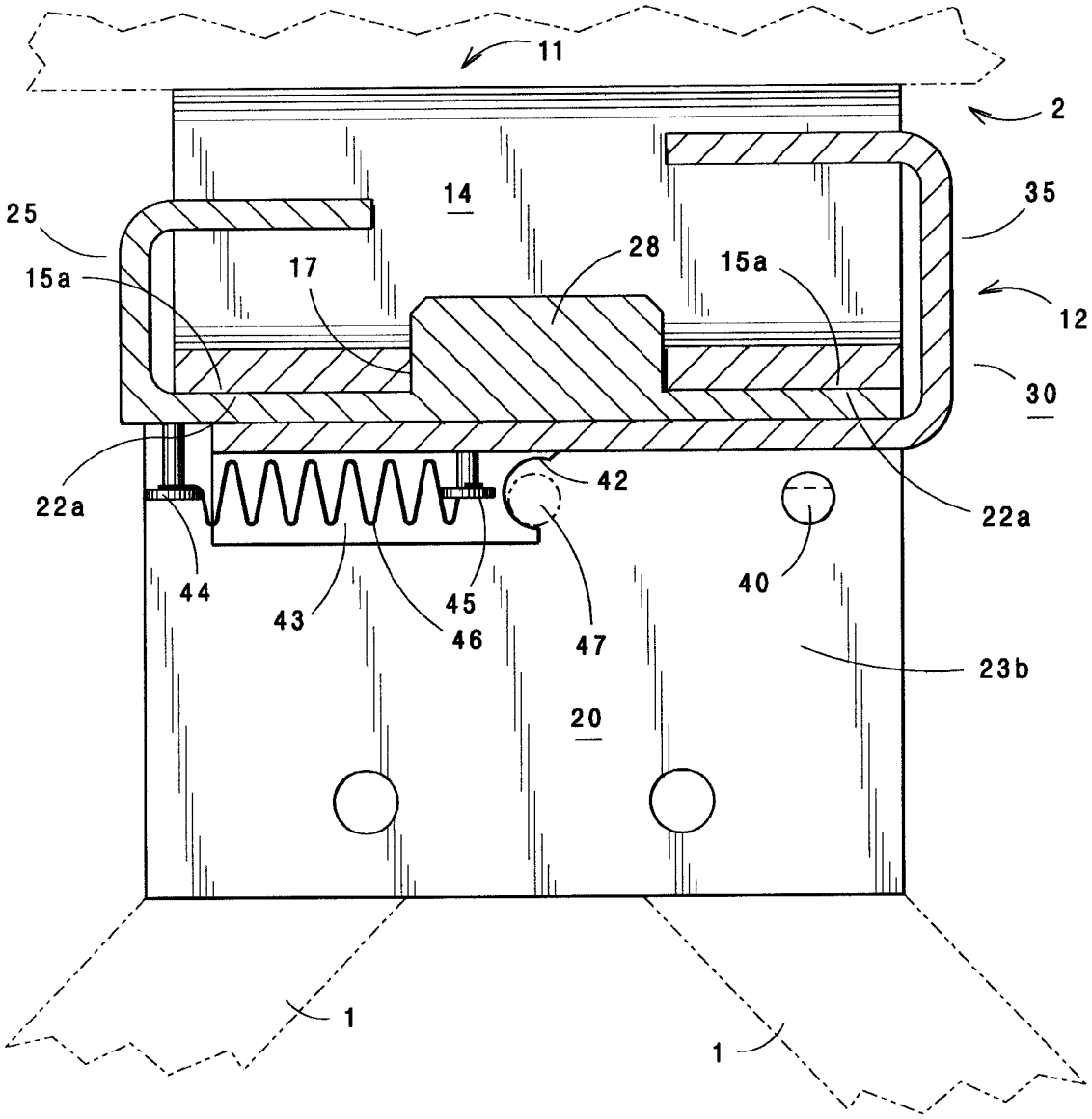
FIG. 7 is an alternate embodiment of the view shown in FIG. 5.

Referring to FIG. 7 of the drawings shows an alternate bias mechanism used to maintain or hold sliding bracket 30 in its closed or clamping position. In this present embodiment, the sliding bracket clamp jaw 35 is biased toward the standing bracket clamp jaw 25 by a tension spring 46. One end of tension spring is fixed to a fastener 45 that extends downward from the sliding bracket at a positioned located between spaced apart flanges 43 that are not unlike flanges 33*a* and 33*b* shown in FIG. 3. The opposite end of spring 46 is fixed to a fastener 44 that extends downward from the sliding bracket at a positioned proximate the location of clamp jaw 25, and the tension applied by spring 46 pulls sliding bracket toward its closed position to maintain jaws 25 and 35 of clamp assembly 12 in there clamped position when inserted into aperture 14 of the frame bracket 11. Referring FIG. 4 showing force X used to attach a clamp assembly to the frame bracket, when a clamp assembly with a tension spring 46 is attached to the frame bracket 11, force X becomes a pulling force applied against the standing bracket 20 in a direction that increases tension in spring 46. Otherwise, a load rest having a clamp assembly with a compression spring bias and a clamp assembly with a tension spring bias function in a similar manner to provide a secure and stable connection between a vehicle and ground-engaging jack.

Optional apertures 47, shown with phantom lines, are positioned along the flanges 23*a* and 23*b* of the standing bracket 20. The optional apertures extend through both flanges and they are adapted to receive pins or fasteners, for example quarter turn latches that can be locked within or released from the apertures. The apertures and locked fasteners are positioned to engage the stop sockets 42 and provide additional support to maintain the sliding bracket in its nested position between the standing bracket flanges 23*a* and 23*b*. The optional apertures may be used with either the tension spring or compression spring sliding bracket as disclosed herein.

Thus, specific compositions and methods of a load-rest optionally for use with a jack to provide a sure and secure connection between a jack and vehicle have been disclosed. Of course, those skilled in the art may contemplate various changes, modifications, and alterations from the teachings of the present disclosure without departing from the intended spirit and scope of the inventive concepts herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. While the principles of the invention have been described above in connection with preferred embodiments, it is to be clearly understood that this description is made only by way of example and not as a limitation of the scope of the invention.

We claim:

1. A load-rest that provides a secure and stable connection between a vehicle and a ground-engaging jack, comprising:

a) a frame bracket fixed to a surface of the vehicle, said frame bracket including a web spaced apart from the vehicle surface to provide a frame bracket open space therebetween;

b) a clamp assembly fixed to said ground-engaging jack, said clamp assembly comprising, i. a first clamp jaw positioned opposite a second clamp jaw biased toward said first clamp jaw, said first clamp jaw and said second clamp jaw shaped for insertion into opposite sides of said frame bracket open space so that said second clamp jaw applies a force that clamps both clamp jaws within said open space when said clamp assembly is attached to the frame bracket, and ii. a tenon aligned with a mortise when said first clamp jaw and said second clamp jaw are inserted into said opposite sides of the frame bracket to provide a mortise and tenon joint between said inserted first clamp jaw and said second clamp jaw;

whereby, when inserted into said open space, the clamp jaws, in combination with the mortise and tenon joint, provides a secure and stable connection between the vehicle and ground-engaging jack when a load is applied during a lift.

2. The load-rest recited in claim 1, wherein said frame bracket is an outside-lip hat section.

3. The load-rest recited in claim 1, wherein said mortise is a through mortise positioned perpendicular to said frame bracket open space.

4. The load-rest recited in claim 1, wherein said second clamp jaw is biased toward said first clamp jaw by a compression spring.

5. The load-rest recited in claim 1, wherein said second clamp jaw is biased toward said first clamp jaw by a tension spring.

6. The load-rest recited in claim 1, wherein said attached clamp assembly is suspended from said frame bracket by at least one of said first or said second clamp jaws with said tenon aligned with said mortise to provide an adjustable lift angle between the vehicle and ground-engaging jack before a load is applied to the jack during a lift.

7. The invention recited in claim 1, wherein said frame bracket open space and said inserted first and second clamp, in combination with said mortise and tenon joint provide a collective geometric design that interactively functions as a unit to prevent jack rotation or twist about a lift angle that extends between the vehicle and the ground-engaging jack.

8. A load-rest that provides a secure and stable connection between a vehicle and a ground-engaging jack, comprising:

a) a frame bracket fixed to a surface of the vehicle, said frame bracket including a web positioned to provide an open space that extends from a first side to a second side of said frame bracket, said open space located between the vehicle surface, said web member including a mortise; and b) a clamp assembly, comprising, i. a standing bracket fixed to the ground-engaging jack and including a clamp jaw shaped for insertion into either one of said first side and said second side of the open space to clamp into said frame bracket, said standing bracket including a tenon positioned to align with said mortise in the web member to provide a mortise and tenon joint when coupled, and ii. a sliding bracket nested within said standing bracket and including a clamp jaw shaped for insertion into said open space side opposite the standing bracket to clamp into said frame bracket, said sliding bracket biased by a spring in a direction toward said standing bracket to maintain both clamp jaws in a clamped position within said frame bracket open space with the ground-engaging jack suspended from said standing bracket.

9. The load-rest recited in claim 8, wherein said frame bracket is an outside-lip hat section.

10. The load-rest recited in claim 8, wherein said mortise is a through mortise positioned perpendicular to said open space.

11. The load-rest recited in claim 8, wherein said sliding bracket is biased toward said standing bracket by a compression spring.

12. The load-rest recited in claim 8, wherein said sliding bracket is biased toward said standing bracket by a tension spring.

13. The load-rest recited in claim 8, wherein the sliding bracket is held in the nested position by said spring so that said sliding bracket clamp jaw is positioned to overlap said standing bracket.

14. The load-rest recited in claim 13, wherein said nested sliding bracket includes flanges positioned at a location between flanges that fix said standing bracket to the ground-engaging jack, said sliding bracket flanges including stop sockets aligned to engage a retainer pin to prevent withdrawal of said sliding bracket the nested position between said flanges.

15. The load-rest recited in claim 14, wherein said sliding bracket is able to float or move within said nested position between said flanges to provide a lift angle adjustment before a load is applied to said ground-engaging jack.

16. The load-rest recited in claim 15, wherein said clamp assembly is suspended from said frame bracket by at least one clamp jaw with said tenon aligned with said mortise to provide said adjustable lift angle.

17. The invention recited in claim 15, wherein said frame bracket open space, said inserted standing bracket clamp jaw, and said sliding bracket clamp jaw, in combination with said mortise and tenon joint, provide a collective geometric design that interactively functions as a unit to prevent jack rotation or twist about said lift angle that extends between the vehicle and the ground-engaging jack when a load is applied to said ground-engaging jack.

18. A ground-engaging jack having an improved load-rest that provides a secure and stable connection with a vehicle when a load is applied to the ground-engaging jack during a lift, said improved load-rest comprising:

a) clamp assembly, comprising, b) a standing bracket that provides a first clamp jaw shaped to engage and clamp into one side of a bracket fixed to the vehicle, said standing bracket including a tenon positioned to align with and couple to a corresponding mortise in said bracket fixed to the vehicle to provide a mortise and tenon joint therebetween , and c) a sliding bracket that provides a second clamp jaw shaped to engage and clamp into a second side of said bracket fixed to the vehicle, said sliding bracket nested between flanges that fix said standing bracket to the ground-engaging jack, said sliding bracket biased in a direction toward said first clamp jaw so that both clamp jaws are maintained in their clamped position, with said tenon aligned with said mortise, and with said ground-engaging jack suspended from the bracket fixed to the vehicle prior to said lift.

19. The ground-engaging jack recited in claim 18, wherein said bracket fixed to the vehicle is an outside lip hat section.

20. The ground-engaging jack recited in claim 18, wherein said sliding bracket biased in a direction toward said first clamp by a compression spring.

21. The ground-engaging jack recited in claim 18, wherein said sliding bracket biased in a direction toward said first clamp by a tension spring.

22. The ground-engaging jack recited in claim 21, wherein said sliding bracket includes a support arbor encircled by said compression spring, said compression spring having one end attached to a retainer pin fixed to said standing bracket, said spring compressed between the support arbor and the retainer pin to bias said sliding bracket toward said standing bracket.

23. The ground-engaging jack recited in claim 18, wherein said clamp assembly is suspended from said bracket fixed to the vehicle by at least one of said clamp jaws with said tenon aligned with said mortise to provide an adjustable lift angle that extends between said ground-engaging jack and the vehicle before a load is applied during said lift.

24. The invention recited in claim 18, wherein said first side and said second side of the bracket fixed to the vehicle, said first clamp jaw, and said second clamp jaw, in combination with said mortise and tenon joint, provide a collective geometric design that interactively functions as a unit to prevent jack rotation or twist about a lift angle that extends between the vehicle and the ground-engaging jack when a load is applied to said ground-engaging jack.

* * * * *